US006933844B2

(12) United States Patent
Augspurger et al.

(10) Patent No.: US 6,933,844 B2
(45) Date of Patent: Aug. 23, 2005

(54) CLOSURE SECURITY SEAL WITH TIME-RECORDING FEATURE

(75) Inventors: Quent Augspurger, Scottsdale, AZ (US); James W. Hill, 2800 N. Central Ave., Suite 1100, Phoenix, AZ (US) 35004

(73) Assignee: James W. Hill, Phoenix, AZ (US)

( * ) Notice: Subject to any disclaimer, the term of this patent is extended or adjusted under 35 U.S.C. 154(b) by 87 days.

(21) Appl. No.: 10/385,939

(22) Filed: Mar. 10, 2003

(65) Prior Publication Data

US 2004/0008585 A1 Jan. 15, 2004

Related U.S. Application Data

(60) Provisional application No. 60/364,845, filed on Mar. 13, 2002.

(51) Int. Cl.[7] ..... G08B 13/08

(52) U.S. Cl. ..... 340/545.1; 340/568.8; 340/525; 340/533; 340/572.3; 292/320; 292/327; 702/178

(58) Field of Search ..... 340/545.1, 545.2, 340/568.8, 572.3, 525, 533; 292/320, 327, 317; 702/178

(56) References Cited

U.S. PATENT DOCUMENTS

| | | | | | |
|---|---|---|---|---|---|
| 4,118,057 | A | * | 10/1978 | Ryan | 292/307 R |
| 4,299,417 | A | * | 11/1981 | McClure | 292/320 |
| 4,766,419 | A | * | 8/1988 | Hayward | 340/545.2 |
| 4,954,810 | A | * | 9/1990 | Llewellyn | 340/686.1 |
| 4,982,985 | A | * | 1/1991 | Atlas | 292/327 |
| 5,097,253 | A | * | 3/1992 | Eschbach et al. | 340/545.1 |
| 6,317,025 | B1 | * | 11/2001 | Leon et al. | 340/5.21 |
| 6,511,108 | B1 | * | 1/2003 | Roessner et al. | 292/320 |

* cited by examiner

*Primary Examiner*—Jeffery Hofsass
*Assistant Examiner*—Daniel Previl
(74) *Attorney, Agent, or Firm*—Gregory J. Nelson

(57) ABSTRACT

A security seal for a freight car, freight container or other enclosure. The seal has an electronic timepiece which displays the time and date and is preset at an established reference time. A cut-resistant strap is secured at one end to the seal and has a latch at the other end. When the latch is passed through a lock and is engaged in a receiver in the seal, the strap is locked in place and the power to the timepiece is interrupted providing an indication of the time and date on which the lock was sealed. Other information may be applied to the seal at the time of sealing such as the identification of the individual responsible for the sealing.

9 Claims, 4 Drawing Sheets

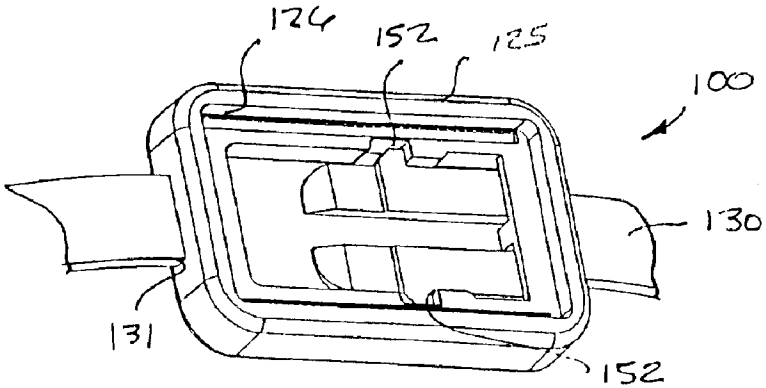
FIGURE 7
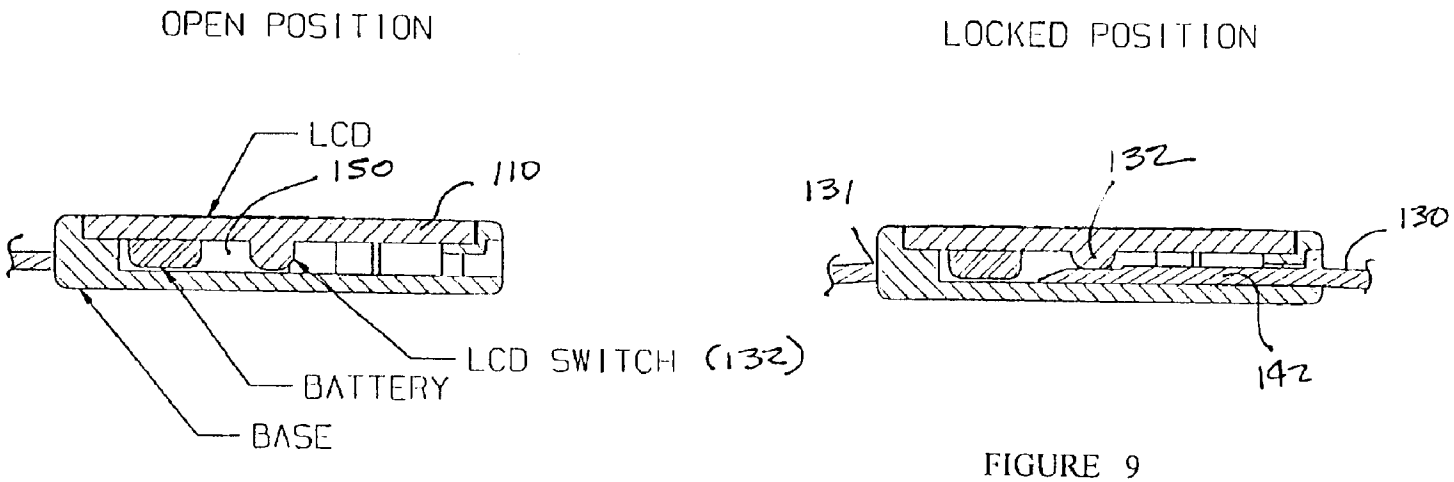
FIGURE 9
FIGURE 8

CLOSURE SECURITY SEAL WITH TIME-RECORDING FEATURE

CROSS REFERENCE TO RELATED APPLICATION

This application is based on provisional application No. 60/364,845, filed Mar. 13, 2002, of the same title.

FIELD OF THE INVENTION

The present invention relates to a device for sealing a closure member and more particularly relates to a device for recording the time of securing a closure such as the door of a truck trailer, freight car, sea container, van or other enclosure.

BACKGROUND OF THE INVENTION

When goods and freight are loaded into an enclosure, such as a freight car, van, truck trailer or the like, the enclosure is usually sealed at the point of dispatch by means of a security seal. One type of seal is a metal or plastic wire which passes through the latch to plates on the door. The seal may be provided with a number, time and date of sealing. At the time of delivery, the seal is inspected to see if it is intact.

U.S. Pat. No. 4,118,057 shows a reusable seal consisting of a body and wire loop, the ends of which pass through holes in the body and are clamped in position by plungers actuated by turning a drum rotatively mounted on the body. A pair of visible balls provide a color code which is changed if the drum is rotated to release and unclamp the wire loop providing an indication that the seal has been tampered with.

U.S. Pat. No. 3,779,589 shows a closed loop security seal for detecting unauthorized opening of the closure means of a freight car, meter casing or the like, which embodies a flexible, plastic strap formed at its opposite ends with relatively engageable catch-and-latch portions for locking insertion with a cooperative channel keeper. The strap is formed with tamper-deterring shoulders arranged to cover the ends of the keeper upon locking insertion of the catch-and-latch portions of the strap within the keeper.

While there are various approaches to providing security seals intended to indicated unauthorized opening or tampering of the closure door of a freight car or similar enclosure, these seals generally have disadvantages. While mechanical seals of the type described above can be engaged to appear locked, when, in fact, they are not. Accordingly, it is not uncommon for individuals involved in the loading operation to apply the seals in a manner so that they appear secure when, in fact, they are not engaged. This allows subsequent removal and theft of contents at which time the seal will be engaged so that the container, upon arrival or upon opening, appears to be fully sealed. It is estimated that tremendous losses of stored goods, cargo and freight occur in this manner.

In an effort to provide a higher level of security, various electronic devices have been developed. For example, U.S. Pat. No. 4,766,419 shows an apparatus for recording the opening and closing of a closure member which provides electrical signal upon opening or closing of the closure member. An electronic circuit generates one of a number of unique codes and stores a generated code. A display device displays a generated code. In one form of the invention, a reusable seal comprises a housing and a cable secured at one end of the housing releasibly attached to the housing at the other end. Operation of a locking mechanism causes an electronic circuit in the housing to generate a random number which is displayed by an LED display. Any change in the number displayed indicates the cable has been released.

U.S. Pat. No. 5,097,253 shows an electronic security device having a communications loop that extends from a control box across the boundary of a portal, such as a door, into a sealed enclosure. The loop must be damaged or moved in order for an entry to be made. The device is adapted to detect unauthorized entries and record the time at which such entry occurs for later reference. The device will also detect attempts to tamper or interfere with operation device and records the time at which such events take place.

Accordingly, a principal object of the present invention is to provide a comparatively inexpensive and easy to use closure seal which will record the time that the seal has been secured so that subsequent inspection can confirm this time. Thus, for example, at the time of dispatch, the seal must be properly engaged in order to cause the time to register. Thus subsequent inspection will indicate whether or not the seal was properly applied at the time of closure, or whether it was left in a condition which would allow subsequent entry.

BRIEF SUMMARY OF THE INVENTION

Briefly, the present invention provides a strap-type security seal having an inexpensive timepiece such as a battery powered digital watch which will display the time and date and which is preset to an established reference time such as Greenwich time. The timepiece mechanism is enclosed in a tamper-proof enclosure such as encased in hard plastic. A flexible member such as a steel cable or cut-resistant band is attached to the timepiece module. The opposite end of the strap carries a plunger which is engageable in a latching receptacle in the timepiece. Once engaged, the locking member cannot be disengaged without damage. The seal is provided to the user with the latch disengaged. At the time of use, the user will extend the cable or band through the appropriate closing members, such as the latch plate on a door, and insert the locking pin into the receptacle which will interrupt the power to the timepiece mechanism stopping the timepiece providing a visual indication of the time and the date on which the seal was secured.

BRIEF DESCRIPTION OF THE DRAWINGS

Further objects and advantages of the present invention will become more apparent from the following description, claims and drawings in which:

FIG. 7 shows the seal locked with the time piece removed; and

FIGS. 8 and 9 are perspective views taken along lines 8—8 and 9—9 of FIGS. 5 and 6, respectively.

DETAILED DESCRIPTION OF THE DRAWINGS

Figure 1:
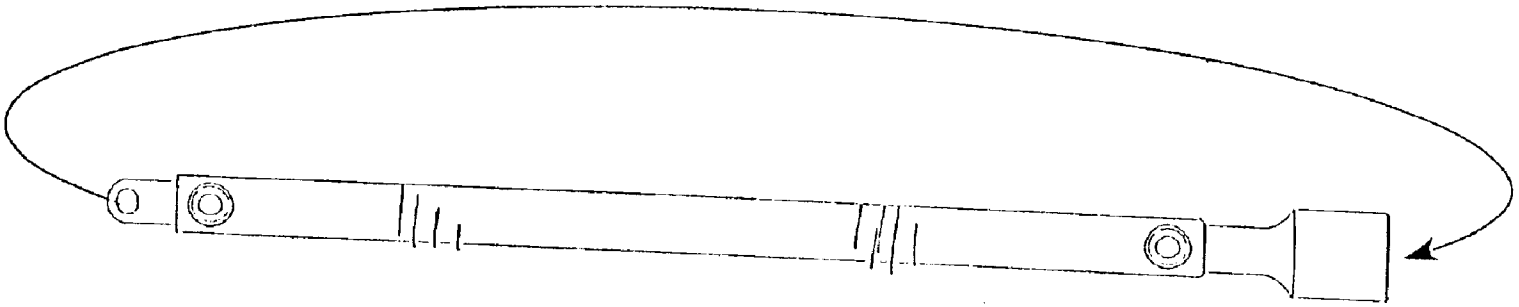
FIGURE 1 (PRIOR ART)
FIG. 1 is a plan view of a prior art sealing strap.

Turning now to the drawings, a representative strap type prior art seal is shown in FIG. 1, which is simply a tamper-proof strap engageable through the lock components such as the staple. The deficiencies of this type of security device have been discussed above.

Figure 2:
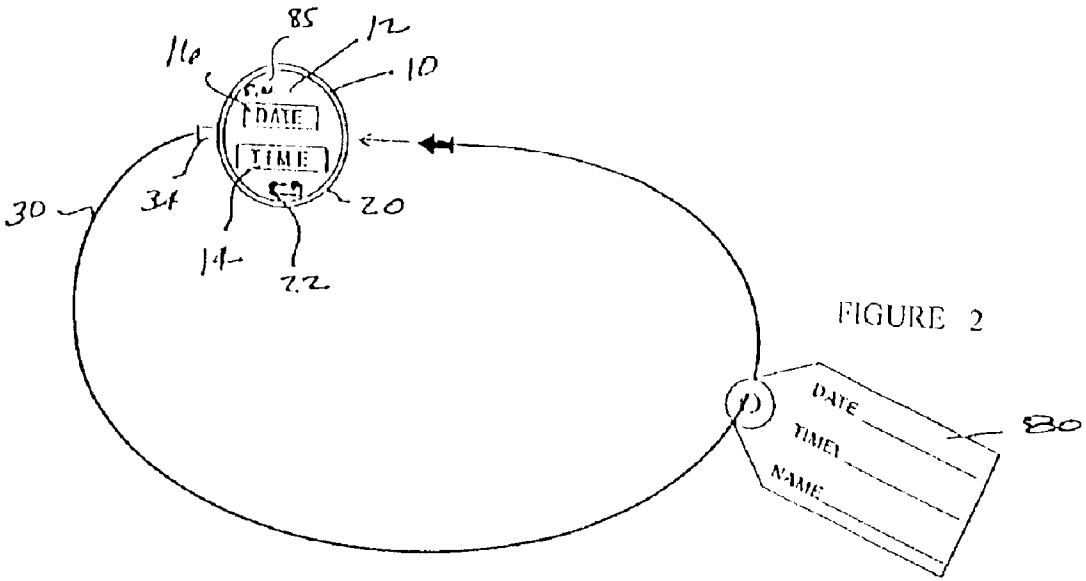
FIG. 2 is a plan view of the security seal of the present invention shown in an open position.
Figure 4:
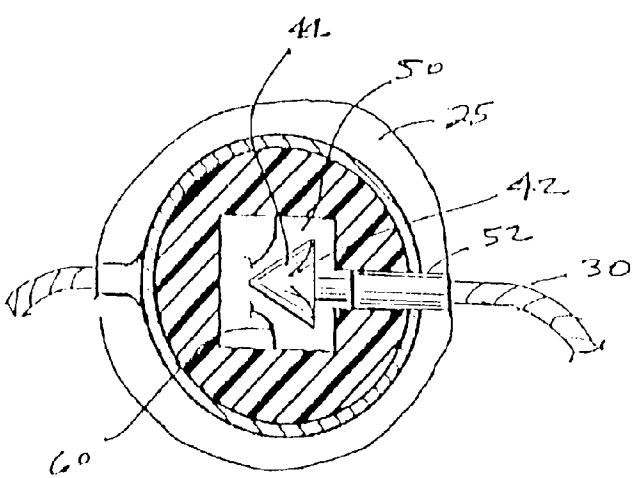
FIG. 4 is a cross-sectional view taken along line 4—4 of FIG. 3 showing the end of the latch engaged in the timepiece so as to interrupt the power supply to the timepiece.
Figure 3:
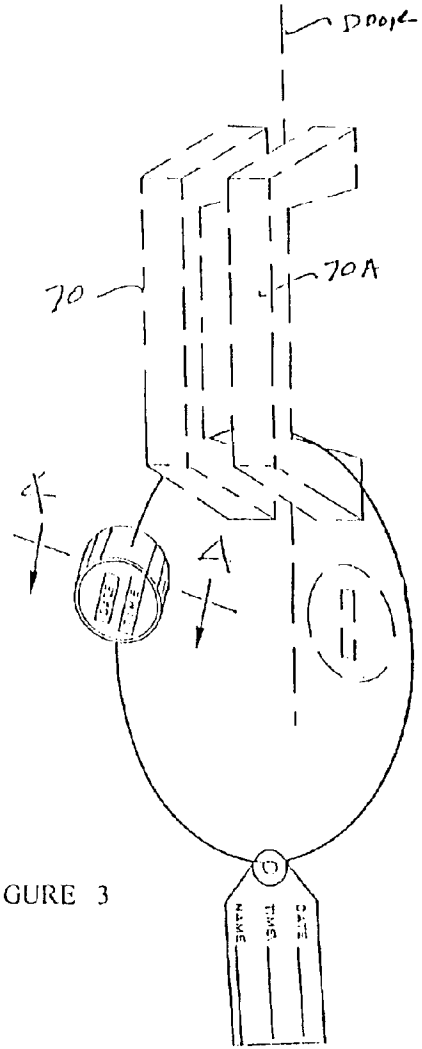
FIG. 3 is a view of the security seal of the present invention shown in a sealed position indicating the time and date of sealing.
Figure 6:
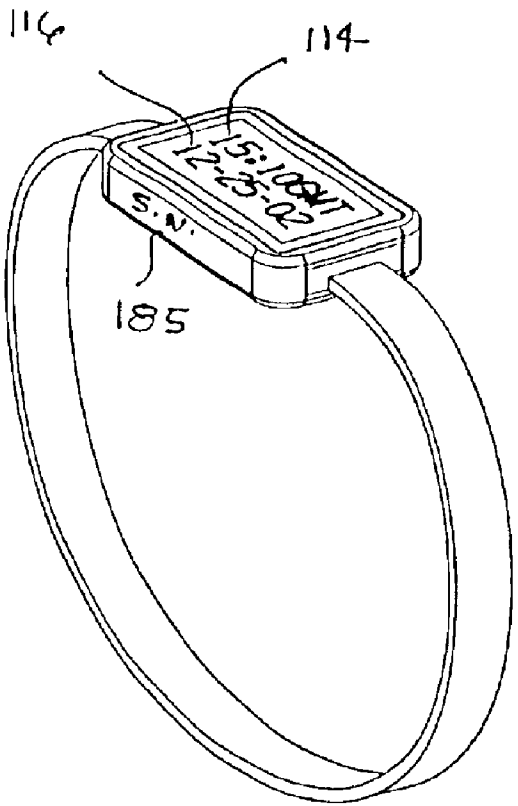
FIG. 6 is a view similar to FIG. 5 with the security seal closed and the time of closure indicated.
Figure 5:
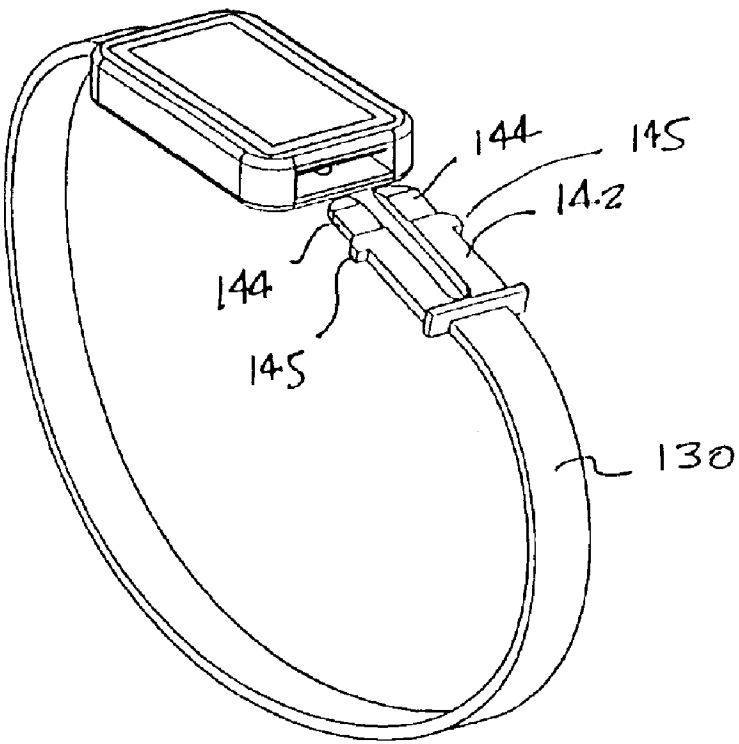
FIG. 5 is a perspective view of another embodiment showing the security seal open.

An embodiment of the security seal of the present invention is seen in FIGS. 2–4 and includes a timepiece module 10. The timepiece module 10 incorporates a battery-operated timepiece. The battery-operated timepiece 12 may be of any conventional type and is preferably an inexpensive timepiece as for example the type having an LED or LCD display displaying the time 14 and having a date calendar 16. Timepieces of this type are well known in the art and, generally, include an oscillator, divider, counter, decoder, driver and display operated by a battery. Reference is made to U.S. Pat. No. 4,398,833 which shows a representative timepiece of this type. It will be appreciated that the particular design of electronic timepieces may vary and that timepieces of this type are well known to those in the art.

The timepiece 10 is enclosed within a housing 20 and has a time display 14 which indicates the hour, minutes and may indicate seconds. In addition, a date calendar 16 is included which indicates the month, day and year. Further indication, such as display 22, is provided showing whether the time indicated is a.m. or p.m. The timepiece and housing are embedded in a tamper-proof enclosure 25 which is preferably a hard, tamper-resistant material, such as a rigid and synthetic resin such as polystyrene, acrylic or the like.

A strap 30 is secured to the housing 12. Preferably the strap 30 shown is a reinforced steel cable which is resistant to cutting. One end 32 of the steel cable is secured to the housing 12 extending into a ferrule or an eyelet 34 and secured by welding, soldering or compression fitting. The ferrule 34 and the end of the cable are preferably encased or "potted" within the enclosure 25 surrounding the timepiece.

The opposite end 30 of the cable carries a latch 42 which is shown as having a barbed-like end with deflectable fingers 44. The barbed end is insertable within a receiver 50 in the side of the timepiece module as best seen in FIG. 4. When the latch 42 is inserted into the receiver 50 in the enclosure through passageway 52, the fingers 44 will deflect inwardly to allow the insertion and, once inserted, will expand to the position shown in FIG. 4. In this position, it will not be possible to withdraw or remove the latch 42 from the receiver 50 as the fingers 44 have expanded to a width greater than the diameter of the passageway 52.

A conductor wire 60 extends across the receiver 50 which is connected in the power circuit of the timepiece. The insertion of the latch 42 will rupture or break the wire, interrupting the power to the watch causing the watch to stop at the time of insertion of the barbed latch.

Figure 4A:
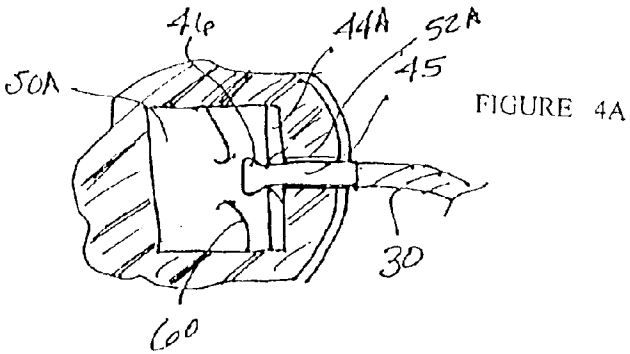
FIG. 4A is a view similar to FIG. 4 showing a variation of the latch.

In FIG. 4A, the end of the cable 30 carries a sleeve 45 with a slightly enlarged end 46. The receiver 50A has deflectable fingers 44A which allows insertion of the sleeve through passageway 52A but will prevent withdrawal of the sleeve. Wire 60 will be broken by insertion of the sleeve end 46 on the end of the cable to interrupt the power supply to the timepiece thus "freezing" the time and date displays.

In use, the seal device is provided to the user in the form shown in FIG. 2 with the latch disengaged from the receiver 50. The timepiece has been preset at the factory to the current date and the time is set to a preestablished reference time such as Greenwich (GMT) time. The electronic timepiece will continue to operate, advancing the date and recording the proper date and time of day until placed in service. At the time the seal is to be used, such as to secure a loaded freight trailer, the seal will then be placed in use. The cable 30 will be extended through mating latching devices, such as latch plates 70, 70A on the door, and the sealing operation completed by inserting the latch 42 into the receiver 50. As pointed out above, this will result in the electrical circuit powering the electronic timepiece to be interrupted, stopping the timepiece. Thus, the time at which the circuit was interrupted will be displayed on the face of the device at displays 14 and 16. Thus, by comparing this information with the dispatch information, confirmation can be made that the seal was engaged at the proper time. This prevents individuals from securing the seal in a manner so that it appears it was properly sealed when, in fact, it is not.

Further, as seen in FIG. 3, the sealed device may be provided with a tag or label 80 on which the individual responsible for loading the freight will place identifying information such as the name or badge number of that individual. Further, the device may be provided with a unique serial number 85 on the case and the serial information can be appropriately recorded on the bill of lading along with the identification of the individual responsible for activating the seal by securing it around the latch plates FIGS. 5 to 9 illustrate another embodiment of the present invention which is designated by the numeral 100 having a cut-resistant band or strap 130 securely fastened to enclosure 125 at one end 131. The opposite end of the strap carries a latch 142 having a pair of deflectable fingers 144 each with a flange 145 that projects from the outer edges of the fingers.

The enclosure 125 has a peripheral lip 126 which receives timepiece 110 having date and hour displays 116 and 114, respectively. The bottom surface of the timepiece 110 has a switch 132 which projects into the receiver cavity 150 when the timepiece and enclosure are assembled as a unit. The receiver cavity also has a pair of opposite recesses 152 which lockingly engage the projections 145 on the fingers 144 when the latch 142 is inserted into the receiver 150 preventing withdrawal of the latch and attached band 130.

The insertion of the latch will also cause the latch to engage the switch on the timepiece causing the timepiece to stop at the time of sealing, as seen in FIG. 9.

The band 130 also provides a surface for application of additional information such as a serial number, logo and an area where the person installing the seal can provide other information such as an employee name or number. The seal 100 is preferably serialized at a suitable location 185

From the foregoing, it will be seen the present invention provides a simple, efficient, easy to use, security seal for freight cars and other enclosures to deter theft and provide improved security. While described with reference to freight handling, it will be understood that the seal has numerous applications such as bonded warehouse storage where verification of the time of an event is required. The invention also provides security in areas such as warehouses and loading docks where a large number of containers may be stored waiting to be unloaded or shipped. In such cases, inspection will indicate tampering and possible security violations.

It will be obvious to those skilled in the art to make various changes, alterations and modifications to the invention described herein. To the extent these various changes, alterations and modifications do not depart from the spirit and scope of the appended claims, they are intended to be encompassed therein.

We claim:

1. A security seal for a closure having a locking member, said security seal comprising:

(a) an electronic timepiece having a power circuit and a time and date display which is preset, said timepiece being enclosed in a protective enclosure defining a receiver;

(b) said timepiece having a power switch disposed in said receiver;

(c) a flexible strap having a first end secured to said enclosure and the opposite end terminating at a latch, said latch and receiver being cooperative to retain said strap upon insertion of said latch into said receiver; and (d) said power switch and latch being cooperative to interrupt the power to said timepiece upon insertion of the latch into the receiver thereby freezing said display to indicate the time and date of sealing.

2. The security seal of claim 1 wherein said retaining member is a barb-like member associated with one of said receiver and latch members.

3. The security seal of claim 1 wherein said protective enclosure is a polymer C material.

4. The security seal of claim 1 wherein said strap is a cut-resistant material.

5. The security seal of claim 1 wherein said seal is provided with a unique serial number.

6. The security seal of claim 1 further including an identification means for entering information concerning the use of the seal.

7. The security seal of claim 1 wherein said deactivating means includes power circuit means which are engaged by insertion of said latch.

8. The security seal of claim 7 wherein said power means comprises a switch in the timepiece power circuit.

9. The security seal of claim 1 wherein the time is displayed as GMT.

* * * * *